US005293727A

United States Patent [19]

Yoshimoto et al.

[11] Patent Number: 5,293,727

[45] Date of Patent: Mar. 15, 1994

[54] PLATE ROOFING MATERIAL

[75] Inventors: Kenichi Yoshimoto; Kazuhiro Sakamoto; Tadashi Akiyama; Hirofumi Takai; Tomomi Nagano; Mitsuji Hashimoto; Kozo Tamamura, all of Inami, Japan

[73] Assignee: Daiken Kogyo K.K., Toyama, Japan

[21] Appl. No.: 796,561

[22] Filed: Nov. 22, 1991

[51] Int. Cl.[5] ..... E04D 1/00

[52] U.S. Cl. ..... 52/560; 52/533; 52/540; 52/554

[58] Field of Search ..... 52/560, 533, 534, 540, 52/553, 554, 555

[56] References Cited

U.S. PATENT DOCUMENTS

| | | | |
|---|---|---|---|
| 2,380,885 | 7/1945 | Wack | 52/554 |
| 3,079,729 | 3/1963 | Newton et al. | 52/554 |
| 3,844,082 | 10/1974 | Martin et al. | 52/540 |
| 3,977,141 | 8/1976 | Peders | 52/534 |
| 4,273,106 | 6/1981 | Gould | 52/540 |
| 4,819,398 | 4/1989 | Dameron | 52/533 |

FOREIGN PATENT DOCUMENTS

| | | | |
|---|---|---|---|
| 3508414 | 9/1986 | Fed. Rep. of Germany | 52/533 |
| 117411 | 4/1976 | Japan . | |

*Primary Examiner*—Carl D. Friedman
*Assistant Examiner*—Wynn E. Wood
*Attorney, Agent, or Firm*—Edwin E. Greigg; Ronald E. Greigg

[57] ABSTRACT

A plate roofing material is divided into an exterior portion which is exposed when a roof is covered with a plate roofing material and an overlap portion which is concealed under an exterior portion of a plate roofing material superimposed on the overlap portion of the plate roofing material. At least one longitudinal groove is formed in the surface of the exterior portion. The longitudinal groove has wide side surface parts alternating with narrow side surface parts with sidewalls formed of a plurality of stepped portions. The longitudinal groove has a linear bottom part having an approximately constant depth and is approximately V-shaped in cross section.

6 Claims, 4 Drawing Sheets

PLATE ROOFING MATERIAL

BACKGROUND OF THE INVENTION

1. Field of the Invention

The present invention relates to a plate roofing material referred to as, for example, artificial slate which is superior in waterproofing properties, good design and handling properties and is made of a cement material.

As the plate roofing material, various ones have been conventionally used. Very important to the roofing material are as follows: First, no leaks in a roof covered with roofing materials are very important. Second, the harmony with a building is very important. That is, the good design of roofing materials, to say nothing of a building roofed over with the roofing materials, is very important in terms of the sight from the streets and the houses. Third, it is important that roofing materials are not easily damaged and are superior in handling properties and workability when the roofing materials are transported from a factory to a construction field and a building is roofed over with the roofing materials in the construction field.

2. Description of the Prior Art

A roofing material raises very important problems in terms of any of the function, the good design, and the handling properties as described above. The good design becomes a more important factor as houses have been recently constructed higher in grade.

As one example of the roofing material, clayslate which is a kind of clay stone has been conventionally well-known as a high-grade natural slate roofing tile. In the roofing work, a roof is covered with roofing materials divided into pieces in a staggered manner such that their jointing lines in the longitudinal direction are not overlapped with each other. Consequently, a massive roof is completed, which is a problem in terms of the workability.

In recent years, the demand for an artificial roofing material superior in workability which is very similar in appearance to natural slate such as clayslate has been increased as houses have been constructed higher in grade. Therefore, a large-sized artificial plate roofing material referred to as, for example, artificial slate made of a cement material to imitate the appearance of natural slate has been proposed. In order that the jointing line in the longitudinal direction of each of the roofing materials is not noticeable and such an appearance is presented that the surface of a roof is covered with a lot of natural slate roofing materials divided into pieces as described above, however, at least one longitudinal groove is formed on the surface of an exposure portion of the roofing material.

In the case of rain with a strong wind such as a typhoon, however, rainwater on the surface of the roofing material is pushed up along the above longitudinal groove by wind pressure, to easily enter an overlapped portion of the roofing material, which causes leaks in the roof. At the present time, therefore, the longitudinal groove is a shallow and narrow one in which rainwater is not easily accumulated. As a result, the surface of the roof lacks a three-dimensional feeling and the design thereof becomes monotonous, so that the present artificial plate roofing material cannot give the surface of the roof a high grade.

On the other hand, as in the invention described in Japanese Utility Model Laid-Open Gazette No. 117411/1976, a roofing material having a groove folded down the middle so that rainwater is not easily pushed up by the wind has been proposed. However, rainwater does not easily flow down in the groove. Consequently, rainwater remains on the surface of a roof so that dust easily adheres thereto, which causes the growth of moss in a long time, spoiling the beauty of the building.

Furthermore, in an artificial plate roofing material which imitates natural slate, a pattern is made out of the surface of natural slate, and a thin and large-sized cement plate roofing material is artificially formed utilizing the pattern. Since a pattern is made out of natural slate, however, the surface of the roofing material is of a rugged pattern which is irregular in height. When a roof is covered with roofing materials, therefore, if a worker walks on a roofing material during the work, the weight of the worker is concentrated on the highest part of the overlapped portion of the roofing material, so that the roofing material is stepped on and broken depending on how the overlapped roofing materials are brought into contact with each other.

Additionally, also when the roofing materials are transported when they are overlapped with each other, the roofing materials are inclined and shaky so that they are easily broken because the overlapped surfaces are not fixed for the same reason.

SUMMARY OF THE INVENTION

The present invention has been made in view of the disadvantages of the conventional example and has for its object to provide a plate roofing material capable of preventing rainwater from being blown up by wind pressure and easily discharging rainwater as well as giving the surface of a roof a high grade filled with a three-dimensional feeling like the appearance of natural slate by forming a groove or grooves in a special shape in the artificial roofing material like natural slate.

Another object of the present invention is to provide a plate roofing material superior in handling properties which is not broken when stepped on during the work and is not broken during the transportation.

In order to attain the above described objects, in the present invention, at least one longitudinal groove having wide parts alternating with narrow parts, having sidewalls formed of a plurality of stepped portions, having a linear bottom part, having an approximately constant depth, and being approximately V-shaped in cross section is formed on the surface of an exposure portion, which is exposed to the exterior when a roof is covered with plate roofing materials, of each of the plate roofing materials.

In the present invention, the above described plate roofing materials are superimposed on the base of the roof to cover the roof, as shown in FIG. 5. In the roof thus covered with the roofing materials, however, rainwater is fanned by the wind to flow back upward in the longitudinal groove in the case of a typhoon with rain. At this time, the narrow part of the longitudinal groove acts as if it were a dam. Consequently, the power of pushing up rainwater is broken and at the same time, rainwater is diffused toward the surface of the roofing material in the wide part on the downstream side of the above narrow part to discharge a part of the rainwater from the longitudinal groove, thereby to prevent rainwater from entering an overlapped portion of the roofing material. In addition, when no rainwater flows back by wind pressure, rainwater rapidly flows down in the longitudinal groove which has an approximately constant depth and has a linear bottom part. Accordingly, no water is accumulated in the longitudinal groove, thereby to eliminate the possibilities of the adhesion of dust and the growth of moss due to the adhesion. Consequently, the good design of the roofing materials is retained for a long time.

Furthermore, the longitudinal groove in the plate roofing material is so formed as to have wide parts alternating with narrow parts and have sidewalls formed of a plurality of stepped portions. Accordingly, when the roof is covered with plate roofing materials, stepped portions appear in all the groove parts, jointing parts and front end parts of the roofing materials, thereby to make it possible to give the roof a high-grade appearance of natural slate which is similar to a broken pattern of plate-shaped grain brought out when clayslate is broken.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2(*b*) is an enlarged sectional view showing a part of medium width of the longitudinal groove in the plate roofing material according to the present invention;

FIG. 2(*c*) is an enlarged sectional view showing a narrowest part of the longitudinal groove in the plate roofing material according to the present invention;

DESCRIPTION OF THE PREFERRED EMBODIMENTS

Figure 1:
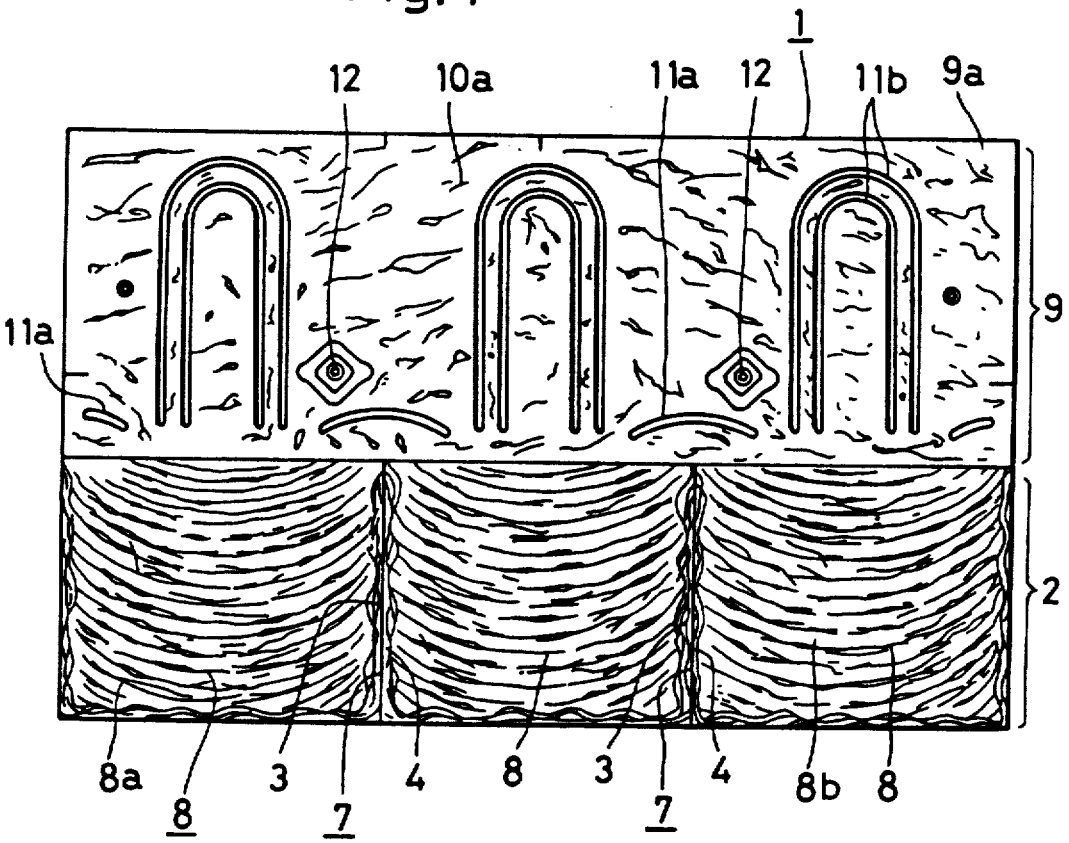
FIG. 1 is a plan view showing one embodiment of a plate roofing material according to the present invention.

The present invention will be described in detail with reference to the drawings. A plate roofing material 1 according to the present invention is a cement roofing material having a thickness of approximately 6 mm which is formed by completely mixing cement, reinforcing fiber, dispersant and the like with a suitable amount of water and then, pressing their mixture. The surface of the plate roofing material 1 is divided into an exposure portion 2 which is exposed to the exterior when the roof is covered with plate roofing materials and an overlapped portion 9 concealed under an exposure portion 2 of a plate roofing material superimposed on the above plate roofing material 1. In describing the plate roofing, the width is perpendicular to a slope of the roof and the length is along the slope of the roof such that the width is parallel with the bottom edge of the roof and the length is perpendicular to the bottom edge of the roof. Two longitudinal grooves 7 are formed on the surface of the exposure portion 2 in the present embodiment. The longitudinal groove 7 is 4.5 mm±0.5 mm deep in the present embodiment. The depth of the longitudinal groove 7 is approximately constant to a base part of the longitudinal groove 7 which is located in the vicinity of the boundary between the exposure portion 2 and the overlapped portion 9 and becomes smaller in the vicinity of the base part. A bottom part 6 of the longitudinal groove 7 is approximately linear. The longitudinal groove 7 ranges in width from 5 to 25 mm on both sides of the center line of the longitudinal groove 7 and has narrow parts 4 alternating with wide parts 3 two or three times. More specifically, the angle of the longitudinal groove 7 is approximately 100° (a minimum of approximately 90°) in the narrowest part having a width of a total of 10 mm, 140° in the widest part having a width of a total of 50 mm, and approximately 120° in the part of medium width.

Figure 2:
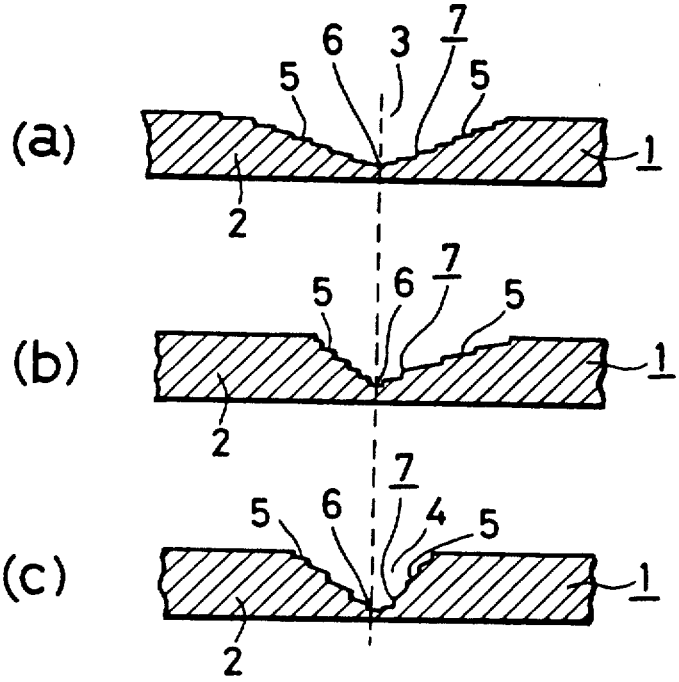
FIG. 2(*a*) is an enlarged sectional view showing a widest part of a longitudinal groove in the plate roofing material according to the present invention.
Figure 3:
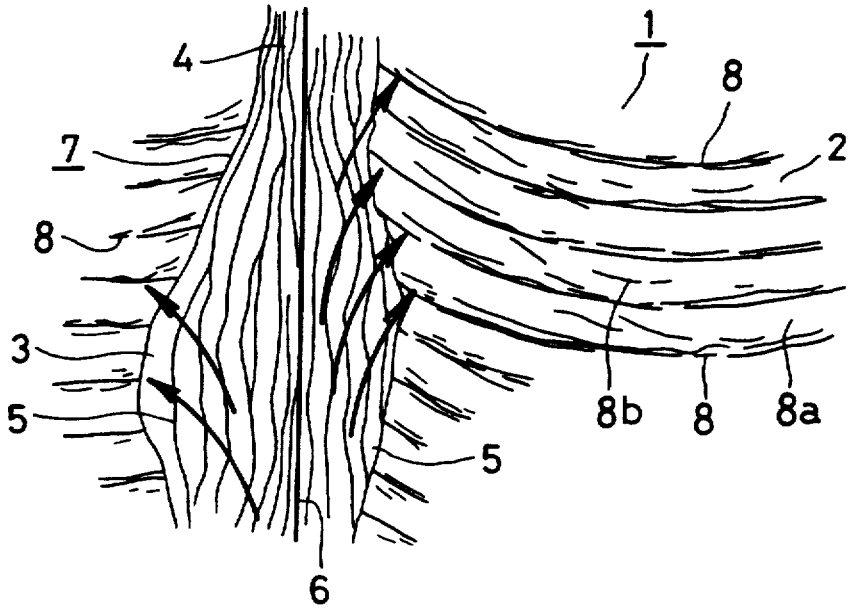
FIG. 3 is an enlarged fragmentary view in plan showing the longitudinal groove in the plate roofing material according to the present invention.
Figure 4:
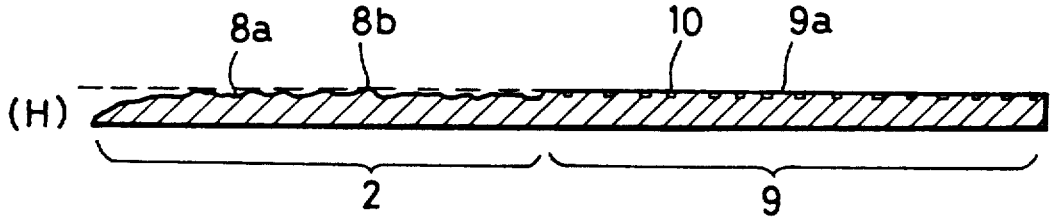
FIG. 4 is a cross sectional view showing one embodiment of the plate roofing material according to the present invention.

The longitudinal groove 7 has cross-sectional shapes as shown in FIGS. 2(*a*) to 2(*c*). The sidewalls of the wide part 3 of the longitudinal groove 7 are provided with two to six stepped portions 5 by an easy gradient while being provided with wide flat surface portions having a width of approximately 2 to 5 mm, and the sidewalls of the narrow part 4 thereof are provided with one to three stepped portions 5 by a steep gradient rising almost vertically.

Furthermore, edges of the longitudinal groove 7 on the surface of the plate roofing material 1 are asymmetrical on both sides of the center line of the longitudinal groove 7, so that a space between the walls of the longitudinal groove 7 has the shape of an irregular zigzag wave. Accordingly, the stepped portions 5 on the sidewalls of the longitudinal groove 7 and the irregular zigzag edges thereof give the plate roofing material 1 an appearance like a broken pattern of plate-shaped grain brought out when natural clayslate is broken.

Furthermore, the surface in the side ends and the top end of the exposure portion 2 is finished to a slope which is a combination of gentle stepped portions 5 and steep stepped portions rising vertically which differ in height.

Additionally, a natural or artificial grained rugged pattern 8 is formed on the surface of the exposure portion 2. In the present embodiment, a circular arc-shaped rugged pattern 8 curved toward the lower edge of the exposure portion 2 is cast from a stripe pattern of plate-shaped grain of natural clayslate on the surface of the exposure portion 2 between the longitudinal grooves 7 and between the longitudinal groove and the side end. The highest part of the rugged pattern is indicated by 8*b*, and the lowest part thereof is indicated by 8*a*.

On the other hand, the surface of the overlapped portion 9 of the plate roofing material 1 is a flat surface, which has grained concave portions 10*a* formed to imitate the exposure portion 2. Circular arc-shaped draining grooves 11*a* gently curved toward the upper edge of the overlapped portion 9 are respectively provided so as to conform to the upper position of the longitudinal grooves 7, and two inverted U-shaped draining grooves 11*b* are provided between the circular arc-shaped draining grooves 11*a*. Reference numeral 12 denotes a pinhole for nailing. The side surface of the overlapped portion 9 is finished to a vertical surface. In addition, the surface of the overlapped portion 9 is finished to a flat surface 9a which is equal in height to a position at the height of the highest part 8b (which is taken as a reference height H) of the rugged pattern 8 on the surface of the exposure portion 2, and the artificial grained concave portions 10 are formed on the flat surface 9a to have an approximately constant depth.

The reverse surface of the plate roofing material 1 is finished to a flat surface.

Figure 5:
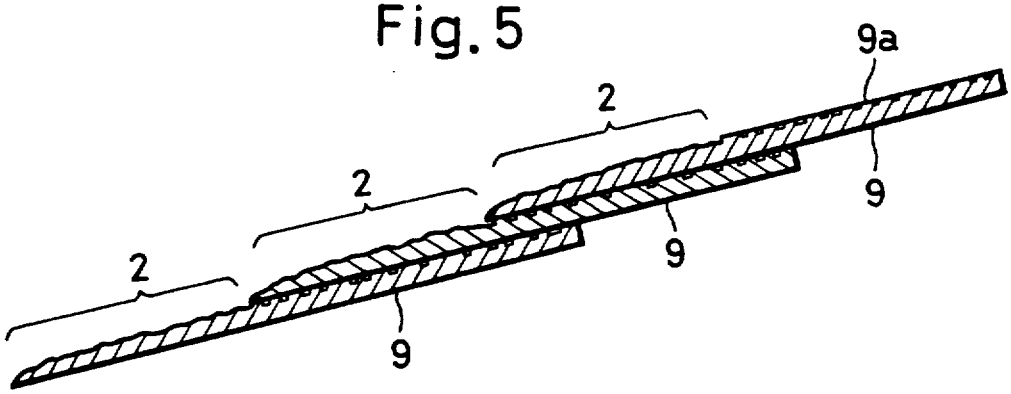
FIG. 5 is a sectional side view showing a part of a state where roofing materials according to the present invention are overlapped with each other.
Figure 6:
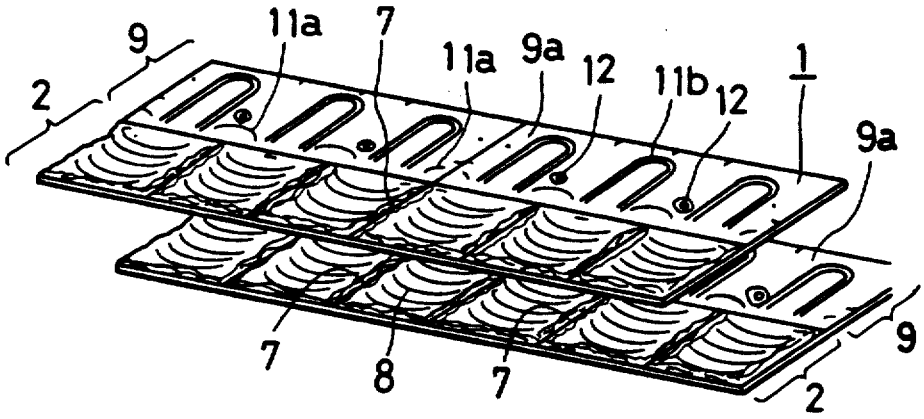
FIG. 6 is a perspective view showing a part of the state where the roofing materials according to the present invention are overlapped with each other.

Therefore, the plate roofing materials are overlapped with each other as shown in FIG. 5 to cover the roof while driving nails. Since the surface of the overlapped portion 9 is made equal in height to the highest part of the exposure portion 2 as described above and the reverse surface of the plate roofing material 1 is finished to a flat surface which is slightly rough, the overlapped portion 9 of the plate roofing material on the lower side and the reverse surface of the plate roofing material on the upper side are entirely brought into contact with each other.

In the roof thus covered with the plate roofing materials, rainwater is fanned by the wind to flow back upward in the longitudinal grooves 7 in the case of a typhoon with rain. However, the narrow part 4 of the longitudinal groove 7 acts as if it were a dam. Accordingly, the power of pushing up rainwater is broken and at the same time, rainwater is diffused toward the surface of the plate roofing material 1 in the wide part 3 on the downstream side of the above narrow part 4 to discharge a part of the rainwater from the longitudinal groove 7. This is repeated, thereby to prevent rainwater from entering the overlapped portion 9 through the longitudinal groove 7. In addition, the rainwater diffused toward the surface of the plate roofing material 1 moves in a direction at approximately right angles to the wave-shaped or circular arc-shaped rugged pattern 8 formed on the exposure portion 2. However, the rugged pattern 8 acts as if it were a dam. Accordingly, the power of pushing up rainwater in the exposure portion 2 is broken, thereby to prevent rainwater from entering the overlapped portion 9. Since rainwater pours on the entire surface of the roof, a part of the rainwater may, in some cases, enter the overlapped portion 9. In the case, however, the above described draining grooves 11a and 11b prevent the rainwater from entering the inner part of the overlapped portion 9. In addition, rainwater attempts to enter the above described overlapped portion 9 due to the capillary phenomenon. However, the entrance of the rainwater due to the capillary phenomenon is prevented because the entire adhesion is prevented due to the concave portions on the surface of the overlapped portion 9. Further, when the edges of the longitudinal groove 7 which varies in width from small to large on the surface of the plate roofing material 1 are asymmetrical on both sides of the center line of the longitudinal groove 7, the wind direction and the water direction in the longitudinal groove 7 are changed when rainwater is blown up by the wind to reach the wide parts 3, to make it easier to discharge rainwater onto the plate roofing material 1.

Furthermore, a part of rainwater flows down in the longitudinal groove 7 even when it is blown up by the wind, to say nothing of a case where it is not blown up by the wind. Since the depth of the groove is approximately constant and the bottom part thereof is approximately linear, however, rainwater rapidly flows down, to eliminate the possibilities of the adhesion of dust due to the accumulation of water in the longitudinal groove 7 and the growth of moss due to the adhesion.

Additionally, when the roof is covered with plate roofing materials, the exposure portion 2 of the plate roofing material on the upper side is superimposed on the overlapped portion 9 of the plate roofing material on the lower side, so that the entire reverse surface of the exposure portion 2 which is a natural grained rugged pattern portion is supported on the flat surface 9a of the overlapped portion 9. Accordingly, the exposure portion 2 is stably supported on the side of the reverse surface thereof irrespective of the irregular height and pattern. Accordingly, even if a worker walks on the plate roofing material 1, no offset bending stress is produced in the above exposure portion 2, so that the plate roofing material 1 is not damaged.

Figure 7:
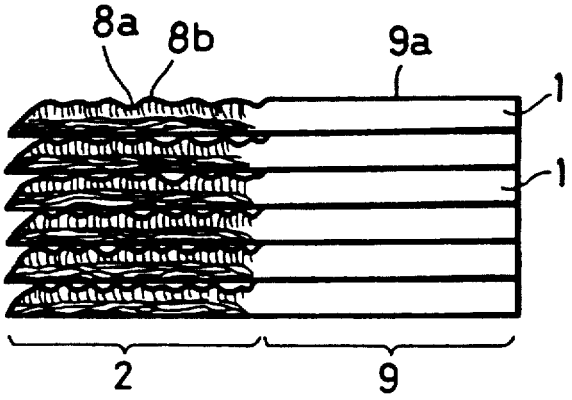
FIG. 7 is a side view showing a state where the roofing materials according to the present invention are piled at the time of the transportation.

Moreover, such plate roofing materials are piled as shown in FIG. 7 to be packed and then, are conveyed to a working field. Since the highest part 8b of the natural grained rugged pattern portion which is the exposure portion 2 of the plate roofing material 1 is equal in height to the flat surface 9a of the overlapped portion 9, however, the highest part 8b of the exposure portion 2 and the flat surface 9a of the overlapped portion 9 are aligned on the same reference surface H. Consequently, the plate roofing materials are horizontally piled without being inclined or being shaky, thereby to make it possible to also reduce the cracking during the conveyance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A plate roofing material having a length which is parallel with a slope of a roof and a width which is perpendicular to the slope, the plate roofing material comprising an irregular upper surface including an exposure portion (2) and an overlap portion (9) along a length thereof, said exposure portion (2) being exposed when installed on the roof and said overlap portion being overlapped by an exposure portion of another plate roofing material when installed on the roof, said plate roofing material having a somewhat uniform smooth back surface over its length and width, said upper surface overlap portion having a generally flat surface, said upper surface exposure portion (2) including at least one longitudinal groove (7) extending from a lower edge of said roofing material on said upper surface exposure portion across a width of the roofing material up to said overlap portion, said at least one longitudinal groove being approximately V-shaped in cross section along the width of plate roofing material, said V-shaped cross section having a narrow part and a wide part with the wide part at the lower edge of said plate roofing material extending in a direction toward the narrow part and to the overlap portion, said longitudinal groove having a plurality of irregular stepped side surfaces and a linear bottom groove having an approximately constant depth and extending from said lower edge of said plate roofing material to said overlap portion.

2. A plate roofing material according to claim 1, wherein said plurality of irregular stepped side surfaces are formed by an easy gradient on the side surfaces of the wide part of the longitudinal groove, and said plurality of irregular stepped side surfaces are formed by a steep gradient rising almost vertically on the side surfaces of the narrow part of the longitudinal groove.

3. The plate roofing material according to claim 1, wherein edges of the longitudinal groove are asymmetrical on opposite sides of a center line of the longitudinal groove so that the longitudinal groove is varied in width from small to large beginning at the overlap portion and extending to the lower edge of the exposure portion.

4. The plate roofing material according to claim 1, wherein the said irregular stepped side surfaces in a lower edge portion of said longitudinal groove and an upper end of the longitudinal groove in the exposure portion is a slope which is a combination of gentle stepped portions and steep stepped portions rising vertically which differ in height.

5. The plate roofing material according to claim 1, wherein a wave-shaped or circular arc-shaped rugged grooved pattern is curved from a direction of said overlap portion toward the lower edge of the exposure portion and is formed in the surface of the exposure portion between a plurality of longitudinal grooves and between the plurality of longitudinal grooves and the side surfaces of the wide and narrow parts of said longitudinal groove.

6. The plate roofing material according to claim 1, wherein the upper surface of the exposure portion is of a rugged pattern with irregular grooves in height which is made out of natural slate, and the upper surface of the overlap portion is a generally flat surface which is aligned with the highest part of the irregular grooves in said exposure portion so that the plate roofing material will not break when stepped upon.

* * * * *